US005855844A

United States Patent [19]

Martin

[11] Patent Number: 5,855,844

[45] Date of Patent: Jan. 5, 1999

[54] HIGH-STRENGTH, NOTCH-DUCTILE PRECIPITATION-HARDENING STAINLESS STEEL ALLOY AND METHOD OF MAKING

[75] Inventor: James W. Martin, Sinking Spring, Pa.

[73] Assignee: CRS Holdings, Inc., Wilmington, Del.

[21] Appl. No.: 907,305

[22] Filed: Aug. 6, 1997

Related U.S. Application Data

[63] Continuation-in-part of Ser. No. 533,159, Sep. 25, 1995, Pat. No. 5,681,528.

[51] Int. Cl.[6] ..... C22C 38/50

[52] U.S. Cl. ..... 420/40; 420/53; 148/327

[58] Field of Search ..... 420/40, 35, 53; 148/327

[56] References Cited

U.S. PATENT DOCUMENTS

| | | |
|---|---|---|
| 3,408,178 | 10/1968 | Myers et al. . |
| 3,556,776 | 1/1971 | Clarke et al. . |
| 3,594,158 | 7/1971 | Sadowski . |
| 5,000,912 | 3/1991 | Bendel et al. . |
| 5,017,246 | 5/1991 | Miyasaka et al. . |
| 5,049,210 | 9/1991 | Miyasaka et al. . |
| 5,310,431 | 5/1994 | Buck . |
| 5,496,421 | 3/1996 | Hashizume et al. . |

OTHER PUBLICATIONS

Swedish Patent Application of Hultin–Stigenberg entitled "Precipitation Hardenable Martensitic Stainless Steel" (published Apr. 8, 1993).

Hultin–Stigenberg et al., "The aging behaviour of a 12Cr–9Ni–4Mo maraging steel used in dental and medical instruments", *Wire*, vol. 44, No. 6, (Dec. 1994), pp. 375–378.

L.L. Starova et al., "Quality Improvement of Welding Wire Sv–08Kh14N7KVM in Microalloying with Rare–Earth and Alkaline–Earth Elements", Avtomathicheskaya Svarka, No. 5, (1988), pp. 66–69 (English translation of Russian document).

Aerospace Material Specification, Steel Bars and Forging, Corrosion and Moderate Heat Resistant, SAE, (1988), pp. 1–6.

Heat and Corrosion Resistant Steels, Metals & Alloys in the Unified Numbering System, 6th Ed., (Feb. 1993), p. 263.

ASTM Specification, Designation: A 194/A194M–96, Standard Specification for Carbon and Alloy Steel–Nuts for Bolts for High–Pressure and High–Temperature Service, (1996), pp. 96–105.

ASTM Specification, Designation: A 314 –95, Standard Specification for Stainless Steel Billets and Bars for Forging, (1995), pp. 90–92.

ASTM Specification, Designation; A 473 –95a, Standard Specification for Stainless Steel Forgings, (1995), pp. 171–174.

ASTM Specification, Designation: A 581/A 581M –95b, Standard Specificaiton for Free–Machining Stainless Steel Wire and Wire Rods, (1995), pp. 287–289.

ASTM Specification, Designation: A 582/A 582M –95b, Standard Specification for Free–Machining Stainless Steel Bars, (1995) pp. 290–292.

ASTM Specification, Designation: A 895 –89 (Reapproved 1994), Standard Specification for Free–Machining Stainless Steel Plate, Sheet, and Strip, (1990), pp. 452–453.

*Primary Examiner*—Deborah Yee

*Attorney, Agent, or Firm*—Dann, Dorfman, Herrell and Skillman, P.C.

[57] ABSTRACT

A precipitation hardenable, martensitic stainless steel alloy is disclosed consisting essentially of, in weight percent, about

| | |
|---|---|
| C | 0.03 max |
| Mn | 1.0 max |
| Si | 0.75 max |
| P | 0.040 max |
| S | 0.020 max |
| Cr | 10–13 |
| Ni | 10.5–11.6 |
| Ti | 1.5–1.8 |
| Mo | 0.25–1.5 |
| Cu | 0.95 max |
| Al | 0.25 max |
| Nb | 0.3 max |
| B | 0.010 max |
| N | 0.030 max |
| Ce | 0.001–0.025 |

the balance essentially iron. The disclosed alloy provides a unique combination of stress-corrosion cracking resistance, strength, and notch toughness even when used to form large cross-section pieces. A method of making such an alloy includes adding cerium during the melting process in a amount sufficient to yield an effective amount of cerium in the alloy product.

18 Claims, No Drawings

HIGH-STRENGTH, NOTCH-DUCTILE PRECIPITATION-HARDENING STAINLESS STEEL ALLOY AND METHOD OF MAKING

This application is a continuation-in-part of application Ser. No. 08/533,159, now U.S. Pat. No. 5,681,528 entitled High-Strength, Notch-Ductile Precipitation-Hardening Stainless Steel Alloy, filed on Sep. 25, 1995, which is incorporated herein by reference.

FIELD OF THE INVENTION

The present invention relates to precipitation hardenable, martensitic stainless steel alloys and in particular to a Cr—Ni—Ti—Mo martensitic stainless steel alloy, and an article made therefrom, having a unique combination of stress-corrosion cracking resistance, strength, and notch toughness.

BACKGROUND OF THE INVENTION

Many industrial applications, including the aircraft industry, require the use of parts manufactured from high strength alloys. One approach to the production of such high strength alloys has been to develop precipitation hardening alloys. A precipitation hardening alloy is an alloy wherein a precipitate is formed within the ductile matrix of the alloy. The precipitate particles inhibit dislocations within the ductile matrix thereby strengthening the alloy.

One of the known age hardening stainless steel alloys seeks to provide high strength by the addition of titanium and columbium and by controlling chromium, nickel, and copper to ensure a martensitic structure. To provide optimum toughness, this alloy is annealed at a relatively low temperature. Such a low annealing temperature is required to form an Fe—Ti—Nb rich Laves phase prior to aging. Such action prevents the excessive formation of hardening precipitates and provides greater availability of nickel for austenite reversion. However, at the low annealing temperatures used for this alloy, the microstructure of the alloy does not fully recrystallize. These conditions do not promote effective use of hardening element additions and produce a material whose strength and toughness are highly sensitive to processing.

In another known precipitation hardenable stainless steel the elements chromium, nickel, aluminum, carbon, and molybdenum are critically balanced in the alloy. In addition, manganese, silicon, phosphorus, sulfur, and nitrogen are maintained at low levels in order not to detract from the desired combination of properties provided by the alloy.

While the known precipitation hardenable, stainless steels have hitherto provided acceptable properties, a need has arisen for an alloy that provides better strength together with at least the same level of notch toughness and corrosion resistance provided by the known precipitation hardenable, stainless steels. An alloy having higher strength while maintaining the same level of notch toughness and corrosion resistance, particularly resistance to stress corrosion cracking, would be particularly useful in the aircraft industry because structural members fabricated from such alloys could be lighter in weight than the same parts manufactured from currently available alloys. A reduction in the weight of such structural members is desirable since it results in improved fuel efficiency.

Given the foregoing, it would be highly desirable to have an alloy which provides an improved combination of stress-corrosion resistance, strength, and notch toughness while being easily and reliably processed.

SUMMARY OF THE INVENTION

The shortcomings associated with the known precipitation hardenable, martensitic stainless steel alloys are solved to a large degree by the alloy in accordance with the present invention. The alloy according to the present invention is a precipitation hardening Cr—Ni—Ti—Mo martensitic stainless steel alloy that provides a unique combination of stress-corrosion cracking resistance, strength, and notch toughness.

The broad, intermediate, and preferred compositional ranges of the precipitation hardening, martensitic stainless steel of the present invention are as follows, in weight percent:

| | Broad | Intermediate | Preferred |
|---|---|---|---|
| C | 0.03 max | 0.02 max | 0.015 max |
| Mn | 1.0 max | 0.25 max | 0.10 max |
| Si | 0.75 max | 0.25 max | 0.10 max |
| P | 0.040 max | 0.015 max | 0.010 max |
| S | 0.020 max | 0.010 max | 0.005 max |
| Cr | 10–13 | 10.5–12.5 | 11.0–12.0 |
| Ni | 10.5–11.6 | 10.75–11.25 | 10.85–11.25 |
| Ti | 1.5–1.8 | 1.5–1.7 | 1.5–1.7 |
| Mo | 0.25–1.5 | 0.75–1.25 | 0.9–1.1 |
| Cu | 0.95 max | 0.50 max | 0.25 max |
| Al | 0.25 max | 0.050 max | 0.025 max |
| Nb | 0.3 max | 0.050 max | 0.025 max |
| B | 0.010 max | 0.001–0.005 | 0.0015–0.0035 |
| N | 0.030 max | 0.015 max | 0.010 max |
| Ce | up to 0.025 | 0.001–0.015 | 0.002–0.010 |

The balance of the alloy is essentially iron except for the usual impurities found in commercial grades of such steels and minor amounts of additional elements which may vary from a few thousandths of a percent up to larger amounts that do not objectionably detract from the desired combination of properties provided by this alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, unless otherwise indicated, percent (%) means percent by weight.

DETAILED DESCRIPTION

In the alloy according to the present invention, the unique combination of strength, notch toughness, and stress-corrosion cracking resistance is achieved by balancing the elements chromium, nickel, titanium, and molybdenum. At least about 10%, better yet at least about 10.5%, and preferably at least about 11.0% chromium is present in the alloy to provide corrosion resistance commensurate with that of a conventional stainless steel under oxidizing conditions. At least about 10.5%, better yet at least about 10.75%, and preferably at least about 10.85% nickel is present in the alloy because it benefits the notch toughness of the alloy. At least about 1.5% titanium is present in the alloy to benefit the strength of the alloy through the precipitation of a nickel-titanium-rich phase during aging. At least about 0.25%, better yet at least about 0.75%, and preferably at least about 0.9% molybdenum is also present in the alloy because it contributes to the alloy's notch toughness. Molybdenum also benefits the alloy's corrosion resistance in reducing media and in environments which promote pitting attack and stress-corrosion cracking.

When chromium, nickel, titanium, and/or molybdenum are not properly balanced, the alloy's ability to transform fully to a martensitic structure using conventional processing techniques is inhibited. Furthermore, the alloy's ability to remain substantially fully martensitic when solution treated and age-hardened is impaired. Under such conditions the strength provided by the alloy is significantly reduced. Therefore, chromium, nickel, titanium, and molybdenum present in this alloy are restricted. More particularly, chromium is limited to not more than about 13%, better yet to not more than about 12.5%, and preferably to not more than about 12.0% and nickel is limited to not more than about 11.6% and preferably to not more than about 11.25%. Titanium is restricted to not more than about 1.8% and preferably to not more than about 1.7% and molybdenum is restricted to not more than about 1.5%, better yet to not more than about 1.25%, and preferably to not more than about 1.1%.

Sulfur and phosphorus tend to segregate to the grain boundaries of this alloy. Such segregation reduces grain boundary adhesion which adversely affects the fracture toughness, notch toughness, and notch tensile strength of the alloy. A product form of this alloy having a large cross-section, i.e., >0.7 $in^2$ (>4 $cm^2$), does not undergo sufficient thermomechanical processing to homogenize the alloy and neutralize the adverse effect of sulfur and phosphorus concentrating in the grain boundaries. For large section size products, a small addition of cerium is preferably made to the alloy to benefit the fracture toughness, notch toughness, and notch tensile strength of the alloy by combining with sulfur and phosphorus to facilitate their removal from the alloy. For the sulfur and phosphorus to be adequately scavenged from the alloy, the ratio of the amount of cerium added to the amount of sulfur present in the alloy is at least about 1:1, better yet at least about 2:1, and preferably at least about 3:1. Only a trace amount (i.e., <0.001%) of cerium need be retained in the alloy for the benefit of the cerium addition to be realized. However, to insure that enough cerium has been added and to prevent too much sulfur and phosphorus from being retained in the final product, at least about 0.001% and better yet at least about 0.002% cerium is preferably present in the alloy. Too much cerium has a deleterious affect on the hot workability of the alloy and on its fracture toughness. Therefore, cerium is restricted to not more than about 0.025%, better yet to not more than about 0.015%, and preferably to not more than about 0.010%. Alternatively, the cerium-to-sulfur ratio of the alloy is not more than about 15:1, better yet not more than about 12:1, and preferably not more than about 10:1. Magnesium, yttrium, or other rare earth metals such as lanthanum can also be present in the alloy in place of some or all of the cerium.

Additional elements such as boron, aluminum, niobium, manganese, and silicon may be present in controlled amounts to benefit other desirable properties provided by this alloy. More specifically, up to about 0.010% boron, better yet up to about 0.005% boron, and preferably up to about 0.0035% boron can be present in the alloy to benefit the hot workability of the alloy. In order to provide the desired effect, at least about 0.001 and preferably at least about 0.0015% boron is present in the alloy.

Aluminum and/or niobium can be present in the alloy to benefit the yield and ultimate tensile strengths. More particularly, up to about 0.25%, better yet up to about 0.10%, still better up to about 0.050%, and preferably up to about 0.025% aluminum can be present in the alloy. Also, up to about 0.3%, better yet up to about 0.10%, still better up to about 0.050%, and preferably up to about 0.025% niobium can be present in the alloy. Although higher yield and ultimate tensile strengths are obtainable when aluminum and/or niobium are present in this alloy, the increased strength is developed at the expense of notch toughness. Therefore, when optimum notch toughness is desired, aluminum and niobium are restricted to the usual residual levels.

Up to about 1.0%, better yet up to about 0.5%, still better up to about 0.25%, and preferably up to about 0.10% manganese and/or up to about 0.75%, better yet up to about 0.5%, still better up to about 0.25%, and preferably up to about 0.10% silicon can be present in the alloy as residuals from scrap sources or deoxidizing additions. Such additions are beneficial when the alloy is not vacuum melted. Manganese and/or silicon are preferably kept at low levels because of their deleterious effects on toughness, corrosion resistance, and the austenite-martensite phase balance in the matrix material.

The balance of the alloy is essentially iron apart from the usual impurities found in commercial grades of alloys intended for similar service or use. The levels of such elements are controlled so as not to adversely affect the desired properties.

In particular, too much carbon and/or nitrogen impair the corrosion resistance and deleteriously affect the toughness provided by this alloy. Accordingly, not more than about 0.03%, better yet not more than about 0.02%, and preferably not more than about 0.015% carbon is present in the alloy. Also, not more than about 0.030%, better yet not more than about 0.015%, not more than about 0.010% nitrogen is present in the alloy. When carbon and/or nitrogen are present in larger amounts, the carbon and/or nitrogen bonds with titanium to form titanium-rich non-metallic inclusions. That reaction inhibits the formation of the nickel-titanium-rich phase which is a primary factor in the high strength provided by this alloy.

Phosphorus is maintained at a low level because of its deleterious effect on toughness and corrosion resistance. Accordingly, not more than about 0.040%, better yet not more than about 0.015%, and preferably not more than about 0.010% phosphorus is present in the alloy.

Not more than about 0.020%, better yet not more than about 0.010%, and preferably not more than about 0.005% sulfur is present in the alloy. Larger amounts of sulfur promote the formation of titanium-rich non-metallic inclusions which, like carbon and nitrogen, inhibit the desired strengthening effect of the titanium. Also, greater amounts of sulfur deleteriously affect the hot workability and corrosion resistance of this alloy and impair its toughness, particularly in a transverse direction.

Too much copper deleteriously affects the notch toughness, ductility, and strength of this alloy. Therefore, the alloy contains not more than about 0.95%, better yet not more than about 0.75%, still better not more than about 0.50%, and preferably not more than about 0.25% copper.

No special techniques are required in melting, casting, or working the alloy of the present invention. Vacuum induction melting (VIM) or vacuum induction melting followed by vacuum arc remelting (VAR) are the preferred methods of melting and refining, but other practices can be used. The preferred method of providing cerium in this alloy is through the addition of mischmetal during VIM. The mischmetal is added in an amount sufficient to yield the necessary amount of cerium, as discussed hereinabove, in the final as-cast ingot. In addition, this alloy can be made using powder metallurgy techniques, if desired. Further, although the alloy of the present invention can be hot or cold worked, cold working enhances the mechanical strength of the alloy.

The precipitation hardening alloy of the present invention is solution annealed to develop the desired combination of properties. The solution annealing temperature should be high enough to dissolve essentially all of the undesired precipitates into the alloy matrix material. However, if the solution annealing temperature is too high, it will impair the fracture toughness of the alloy by promoting excessive grain growth. Typically, the alloy of the present invention is solution annealed at 1700° F.–1900° F. (927° C.–1038° C.) for 1 hour and then quenched.

When desired, this alloy can also be subjected to a deep chill treatment after it is quenched, to further develop the high strength of the alloy. The deep chill treatment cools the alloy to a temperature sufficiently below the martensite finish temperature to ensure the completion of the martensite transformation. Typically, a deep chill treatment consists of cooling the alloy to below about −100° F. (−73° C.) for about 1 hour. However, the need for a deep chill treatment will be affected, at least in part, by the martensite finish temperature of the alloy. If the martensite finish temperature is sufficiently high, the transformation to a martensitic structure will proceed without the need for a deep chill treatment. In addition, the need for a deep chill treatment may also depend on the size of the piece being manufactured. As the size of the piece increases, segregation in the alloy becomes more significant and the use of a deep chill treatment becomes more beneficial. Further, the length of time that the piece is chilled may need to be increased for large pieces in order to complete the transformation to martensite. For example, it has been found that in a piece having a large cross-sectional area, a deep chill treatment lasting about 8 hours is preferred for developing the high strength that is characteristic of this alloy.

The alloy of the present invention is age hardened in accordance with techniques used for the known precipitation hardening, stainless steel alloys, as are known to those skilled in the art. For example, the alloys are aged at a temperature between about 900° F. (482° C.) and about 1150° F. (621° C.) for about 4 hours. The specific aging conditions used are selected by considering that: (1) the ultimate tensile strength of the alloy decreases as the aging temperature increases; and (2) the time required to age harden the alloy to a desired strength level increases as the aging temperature decreases.

The alloy of the present invention can be formed into a variety of product shapes for a wide variety of uses and lends itself to the formation of billets, bars, rod, wire, strip, plate, or sheet using conventional practices. The alloy of the present invention is useful in a wide range of practical applications which require an alloy having a good combination of stress-corrosion cracking resistance, strength, and notch toughness. In particular, the alloy of the present invention can be used to produce structural members and fasteners for aircraft and the alloy is also well suited for use in medical or dental instruments.

TABLE 1

| Ex./Ht. No. | C | Mn | Si | P | S | Cr | Ni | Mo | Cu | Ti | B | N | Nb | Al | Ce | Fe |
|---|---|---|---|---|---|---|---|---|---|---|---|---|---|---|---|---|
| 1 | 0.003 | 0.09 | 0.02 | 0.006 | 0.003 | 11.54 | 11.13 | 1.00 | 0.05 | 1.61 | 0.0013 | 0.004 | <0.01 | — | — | Bal. |
| 2 | 0.006 | 0.08 | 0.05 | 0.008 | 0.005 | 11.57 | 11.02 | 1.00 | 0.05 | 1.52 | 0.0019 | 0.004 | <0.01 | <0.01 | — | Bal. |
| 3 | 0.009 | 0.08 | 0.04 | 0.008 | 0.004 | 11.61 | 11.03 | 1.00 | 0.06 | 1.68 | 0.0021 | 0.005 | <0.01 | <0.01 | — | Bal. |
| 4 | 0.008 | 0.08 | 0.05 | 0.007 | 0.004 | 11.60 | 11.05 | 1.43 | 0.05 | 1.52 | 0.0020 | 0.005 | <0.01 | <0.01 | — | Bal. |
| 5 | 0.012 | 0.08 | 0.07 | 0.010 | 0.001 | 11.58 | 10.46 | 1.00 | 0.06 | 1.58 | 0.0024 | 0.004 | <0.01 | <0.01 | — | Bal. |
| 6 | 0.008 | 0.10 | 0.07 | 0.009 | 0.003 | 11.54 | 10.77 | 1.00 | 0.05 | 1.55 | 0.0020 | 0.004 | <0.01 | <0.01 | — | Bal. |
| 7 | 0.008 | 0.10 | 0.05 | 0.009 | 0.002 | 11.62 | 11.05 | 0.99 | 0.07 | 1.58 | 0.0030 | 0.003 | <0.01 | 0.017 | — | Bal.[1] |
| 8 | 0.007 | 0.07 | 0.06 | 0.010 | 0.001 | 11.63 | 10.92 | 0.75 | 0.06 | 1.58 | 0.0024 | 0.004 | <0.01 | <0.01 | — | Bal. |
| 9 | 0.003 | 0.08 | 0.07 | 0.009 | 0.001 | 11.49 | 10.84 | 0.50 | 0.06 | 1.58 | 0.0023 | 0.004 | <0.01 | <0.01 | — | Bal. |
| 10 | 0.012 | 0.08 | 0.07 | 0.009 | 0.002 | 11.60 | 10.84 | 0.28 | 0.06 | 1.50 | 0.0025 | 0.002 | <0.01 | 0.01 | — | Bal. |
| 11 | 0.007 | 0.10 | 0.05 | 0.010 | 0.001 | 11.62 | 10.99 | 1.49 | 0.06 | 1.67 | 0.0020 | 0.004 | <0.01 | 0.014 | — | Bal.[2] |
| 12 | 0.006 | 0.08 | 0.05 | 0.007 | 0.005 | 11.58 | 11.08 | 0.98 | 0.05 | 1.52 | 0.0017 | 0.005 | 0.26 | <0.01 | — | Bal. |
| 13 | 0.007 | 0.08 | 0.05 | 0.007 | 0.005 | 11.56 | 10.98 | 1.00 | 0.05 | 1.70 | 0.0016 | 0.004 | 0.25 | <0.01 | — | Bal. |
| 14 | 0.006 | 0.08 | 0.05 | 0.007 | 0.005 | 11.55 | 11.02 | 1.02 | 0.05 | 1.54 | 0.0018 | 0.005 | <0.01 | 0.22 | — | Bal. |
| 15 | 0.008 | 0.06 | 0.04 | 0.007 | 0.005 | 11.62 | 11.03 | 1.03 | 0.05 | 1.54 | 0.0017 | 0.005 | 0.25 | 0.20 | — | Bal. |
| 16 | 0.007 | 0.08 | 0.04 | 0.006 | 0.005 | 11.68 | 11.09 | 1.47 | 0.05 | 1.52 | 0.0017 | 0.004 | 0.26 | <0.01 | — | Bal. |
| 17 | 0.008 | 0.08 | 0.05 | 0.006 | 0.003 | 11.56 | 10.98 | 1.00 | 0.92 | 1.49 | 0.0020 | 0.004 | 0.25 | <0.01 | — | Bal. |
| 18 | 0.009 | 0.08 | 0.04 | 0.005 | 0.005 | 11.60 | 11.05 | 1.01 | 0.92 | 1.51 | 0.0024 | 0.004 | <0.01 | <0.01 | — | Bal. |
| 19[3] | 0.011 | 0.09 | 0.05 | 0.008 | 0.0010 | 11.63 | 11.05 | 1.26 | 0.06 | 1.58 | 0.0014 | 0.0050 | <0.01 | 0.01 | — | Bal. |
| 20[3] | 0.006 | 0.01 | <0.01 | <0.005 | 0.0012 | 11.60 | 11.07 | 1.26 | 0.02 | 1.60 | 0.0013 | 0.0072 | <0.01 | <0.01 | — | Bal. |
| 21[3] | 0.004 | 0.05 | 0.04 | 0.005 | 0.0008 | 11.66 | 10.81 | 0.75 | 0.05 | 1.60 | 0.0021 | 0.0056 | <0.01 | <0.01 | <0.001 | Bal. |
| 22[3] | 0.002 | 0.05 | 0.05 | <0.005 | 0.0007 | 11.62 | 11.21 | 1.05 | 0.05 | 1.58 | 0.0021 | 0.0050 | <0.01 | <0.01 | <0.001 | Bal. |
| 23[3] | 0.005 | 0.05 | 0.05 | <0.005 | <0.0005 | 11.65 | 10.91 | 0.75 | 0.06 | 1.61 | 0.0020 | 0.0065 | <0.01 | <0.01 | <0.001 | Bal. |
| 24[3] | 0.008 | 0.05 | 0.04 | <0.005 | <0.0005 | 11.64 | 10.89 | 0.85 | 0.05 | 1.58 | 0.0019 | 0.0059 | <0.01 | <0.01 | <0.001 | Bal. |
| 25[3] | 0.002 | 0.07 | 0.03 | <0.005 | 0.0006 | 11.63 | 10.99 | 1.00 | 0.05 | 1.56 | 0.0020 | 0.0043 | <0.01 | <0.01 | <0.001[4] | Bal. |
| 26[3,6] | 0.009 | 0.01 | 0.04 | <0.005 | <0.0005 | 11.60 | 11.00 | 1.26 | 0.01 | 1.63 | 0.0016 | 0.0042 | <0.01 | <0.01 | 0.006 | Bal. |
| 27[3,5] | 0.004 | 0.01 | <0.01 | <0.005 | 0.0005 | 11.59 | 11.03 | 1.26 | <0.01 | 1.60 | 0.0026 | 0.0046 | <0.01 | <0.01 | 0.002 | Bal. |
| 28[3,5] | 0.002 | 0.05 | 0.05 | <0.005 | <0.0005 | 11.61 | 11.14 | 0.90 | 0.05 | 1.60 | 0.0022 | 0.0038 | <0.01 | <0.01 | 0.004 | Bal. |
| 29[3,5] | 0.004 | 0.05 | 0.04 | <0.005 | <0.0005 | 11.55 | 10.78 | 0.75 | 0.05 | 1.57 | 0.0016 | 0.0044 | <0.01 | <0.01 | 0.003 | Bal. |
| 30[3,5] | 0.007 | 0.07 | 0.03 | <0.005 | <0.0005 | 11.70 | 11.08 | 1.00 | 0.05 | 1.53 | 0.0022 | 0.0045 | <0.01 | <0.01 | 0.002 | Bal. |
| A | 0.030 | 0.02 | 0.02 | 0.004 | 0.006 | 12.63 | 8.17 | 2.13 | 0.03 | 0.01 | <0.0020 | 0.006 | <0.01 | 1.10 | — | Bal. |
| B | 0.035 | 0.06 | 0.06 | 0.002 | 0.003 | 12.61 | 8.20 | 2.14 | 0.06 | 0.016 | <0.0010 | 0.003 | <0.01 | 1.14 | — | Bal.[2] |
| C | 0.007 | 0.08 | 0.04 | 0.008 | 0.003 | 11.66 | 8.61 | 0.11 | 2.01 | 1.10 | 0.0022 | 0.005 | 0.25 | <0.01 | — | Bal. |
| D | 0.006 | 0.08 | 0.05 | 0.004 | 0.002 | 11.58 | 8.29 | 0.09 | 2.14 | 1.18 | 0.0028 | 0.005 | 0.24 | 0.022 | — | Bal.[1] |

[1]Also contains 0.002% zirconium
[2]Also contains <0.002% zirconium
[3]Also contains 0.0009–0.0022 weight percent oxygen
[4]Although essentially no cerium was recovered, a mischmetal addition was made during vacuum induction melting
[5]Also contains 0.001 weight percent lanthanum
[6]Also contains 0.002 weight percent lanthanum

EXAMPLES

In order to demonstrate the unique combination of properties provided by the present alloy, Examples 1–24 of the alloy described in co-pending application Ser. No. 08/533,159 and Examples 25–30 of the present invention, having the compositions in weight percent shown in Table 1, were prepared. For comparison purposes, Comparative Heats A–D with compositions outside the range of the present invention were also prepared. Their weight percent compositions are also included in Table 1.

Alloys A and B are representative of one of the known precipitation hardening, stainless steel alloys and Alloys C and D are representative of another known precipitation hardening, stainless steel alloy.

Example 1 was prepared as a 17 lb. (7.7 kg) laboratory heat which was vacuum induction melted and cast as a 2.75 inch (6.98 cm) tapered square ingot. The ingot was heated to 1900° F. (1038° C.) and press-forged to a 1.375 inch (3.49 cm) square bar. The bar was finish-forged to a 1.125 inch (2.86 cm) square bar and air-cooled to room temperature. The forged bar was hot rolled at 1850° F. (1010° C.) to a 0.625 inch (1.59 cm) round bar and then air-cooled to room temperature.

Examples 2–4 and 12–18, and Comparative Heats A and C were prepared as 25 lb. (11.3 kg) laboratory heats which were vacuum induction melted under a partial pressure of argon gas and cast as 3.5 inch (8.9 cm) tapered square ingots. The ingots were press-forged from a starting temperature of 1850° F. (1010° C.) to 1.875 inch (4.76 cm) square bars which were then air-cooled to room temperature. The square bars were reheated, press-forged from the temperature of 1850° F. (1010° C.) to 1.25 inch (3.18 cm) square bars, reheated, hot-rolled from the temperature of 1850° F. (1010° C.) to 0.625 inch (1.59 cm) round bars, and then air-cooled to room temperature.

Examples 5, 6, and 8–10 were prepared as 37 lb. (16.8 kg) laboratory heats which were vacuum induction melted under a partial pressure of argon gas and cast as 4 inch (10.2 cm) tapered square ingots. The ingots were press-forged from a starting temperature of 1850° F. (1010° C.) to 2 inch (5.1 cm) square bars and then air-cooled. A length was cut from each 2 inch (5.1 cm) square forged bar and forged from a temperature of 1850° F. (1010° C.) to 1.31 inch (3.33 cm) square bar. The forged bars were hot rolled at 1850° F. (1010° C.) to 0.625 inch (1.59 cm) round bars and air cooled to room temperature.

Examples 7 and 11, and Comparative Heats B and D were prepared as 125 lb. (56.7 kg) laboratory heats which were vacuum induction melted under a partial pressure of argon gas and cast as 4.5 inch (11.4 cm) tapered square ingots. The ingots were press-forged from a starting temperature of 1850° F. (1010° C.) to 2 inch (5.1 cm) square bars and then air-cooled to room temperature. The bars were reheated and then forged from a temperature of 1850° F. (1010° C.) to 1.31 inch (3.33 cm) square bars. The forged bars were hot rolled at 1850° F. (1010° C.) to 0.625 inch (1.59 cm) round bars and air cooled to room temperature.

Examples 19–30 were prepared as approximately 380 lb. (172 kg) heats which were vacuum induction melted and cast as 6.12 inch (15.6 cm) diameter electrodes. Prior to casting each of the electrodes, mischmetal was added to the respective VIM heats for Examples 25–30. The amount of each addition was selected to result in a desired retained-amount of cerium after refining. The electrodes were vacuum-arc remelted and cast as 8 inch (20.3 cm) diameter ingots. The ingots were heated to 2300° F. (1260° C.) and homogenized for 4 hours at 2300° F. (1260° C.). The ingots were furnace cooled to 1850° F. (1010° C.) and soaked for 10 minutes at 1850° F. (1010° C.) prior to press forging. The ingots were then press forged to 5 inch (12.7 cm) square bars as follows. The bottom end of each ingot was pressed to a 5 inch (12.7 cm) square. The forging was then reheated to 1850° F. (1010° C.) for 10 minutes prior to pressing the top end to a 5 inch (12.7 cm) square. The as-forged bars were cooled in air from the finishing temperature.

The resulting 5 inch (12.7 cm) square bars of Examples 19–24 and 26–29 were cut in half with the billets from the top and bottom ends being separately identified. Each billet from the bottom end was reheated to 1850° F. (1010° C.), soaked for 2 hours, press forged to 4.5 inch (11.4 cm) by 2.75 inch (6.98 cm) bars and air-cooled to room temperature. Each billet from the top end was reheated to 1850° F. (1010° C.) and soaked for 2 hours. For Examples 19–24 and 27–29, each top end billet was then press forged to 4.5 inch (11.4 cm) by 1.5 inch (3.8 cm) bars and air-cooled to room temperature. For Example 26, the top end billet was forged to 4.75 inch (12.1 cm) by 2 inch (5.1 cm) bars, reheated to 1850° F. (1010° C.) for 15 minutes, press forged to 4.5 inch (11.4 cm) by 1.5 inch (3.8 cm) bars and then air-cooled to room temperature.

The 5 inch (12.7 cm) square bars of Examples 25 and 30 were cut in thirds and in half, respectively. The billets were then reheated to 1850° F. (1010° C.), soaked for 2 hours, press forged to 4.5 inch (11.4 cm) by 1.625 inch (4.13 cm) bars, and then air-cooled to room temperature.

With reference to Examples 1–18 and Heats A–D, the bars of each Example and Comparative Heat were rough turned to produce smooth tensile, stress-corrosion, and notched tensile specimens having the dimensions indicated in Table 2. Each specimen was cylindrical with the center of each specimen being reduced in diameter with a minimum radius connecting the center section to each end section of the specimen. The stress-corrosion specimens were polished to a nominal gage diameter with a 400 grit surface finish.

TABLE 2

| | Center Section | | | | | |
|---|---|---|---|---|---|---|
| Specimen Type | Length in./ca | Diameter in./cm | Length in./cm | Diameter in./cm | Minimum radius in./cm | Gage diameter in. (cm) |
| Smooth tensile | 3.5/8.9 | 0.5/1.27 | 1.0/2.54 | 0.25/0.64 | 0.1875/0.476 | — |
| Stress-corrosion | 5.5/14.0 | 0.436/1.11 | 1.0/2.54 | 0.25/0.64 | 0.25/0.64 | 0.225/0.57 |
| Notched tensile[(1)] | 3.75/9.5 | 0.50/1.27 | 1.75/4.4 | 0.375/0.95 | 0.1875/0.476 | — |

[(1)]A notch was provided around the center of each notched tensile specimen. The specimen diameter was 0.252 in. (0.64 cm) at the base of the notch; the notch root radius was 0.0010 inches (0.0025 cm) to produce a stress concentration factor ($K_t$) of 10.

The test specimens of Examples 1–18 and Heats A–D were heat treated in accordance with Table 3 below. The heat treatment conditions used were selected to provide peak strength.

TABLE 3

| | Solution Treatment | Aging Treatment |
|---|---|---|
| Exs. 1–18 | 1800° F. (982° C.)/1 hour/WQ[1,2] | 900° F. (482° C.)/4 hours/AC[3] |
| Hts. A and B | 1700° F. (927° C.)/1 hour/WQ[4] | 950° F. (510° C.)/4 hours/AC |

TABLE 3-continued

| | Solution Treatment | Aging Treatment |
|---|---|---|
| Hts. C and D | 1500° F. (816° C.)/1 hour/WQ | 900° F. (482° C.)/4 hours/AC |

[1]WQ = water quenched.
[2]Cold treated at −100° F. (−73° C.) for 1 hour then warmed in air.
[3]AC = air cooled.
[4]Cold treated at 33° F. (0.6° C.) for 1 hour then warmed in air.

The mechanical properties of Examples 1–18 were compared with the properties of Comparative Heats A–D. The properties measured include the 0.2% yield strength (0.2% YS), the ultimate tensile strength (UTS), the percent elongation in four diameters (% Elong.), the percent reduction in area (% Red.), and the notch tensile strength (NTS). All of the properties were measured along the longitudinal direction. The results of the measurements are given in Table 4.

TABLE 4

| Ex./Ht. No. | Cr | Ni | Mo | Ti | .2% YS (ksi/MPa) | UTS (ksi/MPa) | % Elong. | % Red. in Area | NTS (ksi/MPa) | NTS/UTS |
|---|---|---|---|---|---|---|---|---|---|---|
| 1 | 11.54 | 11.13 | 1.00 | 1.61 | 253.7/1749 | 264.3/1822 | 12.0 | 50.5 | 309.0/2130* | 1.17 |
| 2 | 11.57 | 11.02 | 1.00 | 1.52 | 244.7/1687 | 256.2/1766 | 14.7 | 53.5 | 341.2/2352* | 1.33 |
| 3 | 11.61 | 11.03 | 1.00 | 1.68 | 246.8/1702 | 260.1/1793 | 12.6 | 49.4 | 324.9/2240* | 1.25 |
| 4 | 11.60 | 11.05 | 1.43 | 1.52 | 244.2/1684 | 256.7/1770 | 14.4 | 58.8 | 352.5/2430* | 1.37 |
| 5 | 11.58 | 10.46 | 1.00 | 1.58 | 248.5/1713* | 266.0/1834* | 11.5* | 49.6* | 288.3/1988* | 1.08 |
| 6 | 11.54 | 10.77 | 1.00 | 1.55 | 251.5/1734* | 268.3/1850* | 11.7* | 51.7* | 324.9/2240* | 1.21 |
| 7 | 11.62 | 11.05 | 0.99 | 1.58 | 240.5/1658* | 261.6/1804* | 11.5* | 51.1* | 344.5/2375* | 1.32 |
| 8 | 11.63 | 10.92 | 0.75 | 1.58 | 250.4/1726* | 267.9/1847* | 12.4* | 54.5* | 361.4/2492* | 1.35 |
| 9 | 11.49 | 10.84 | 0.50 | 1.58 | 251.4/1733* | 267.9/1847* | 11.3* | 50.6* | 339.3/2339* | 1.27 |
| 10 | 11.60 | 10.84 | 0.28 | 1.50 | 248.4/1713* | 264.5/1824* | 12.1* | 57.0* | 347.3/2395* | 1.31 |
| 11 | 11.62 | 10.99 | 1.49 | 1.67 | 227.6/1569* | 255.6/1762* | 11.6* | 47.9* | 332.8/2295* | 1.30 |
| 12 | 11.58 | 11.08 | 0.98 | 1.52 | 250.7/1728 | 262.4/1809 | 12.2 | 52.4 | 312.2/2153* | 1.19 |
| 13 | 11.56 | 10.98 | 1.00 | 1.70 | 255.8/1764 | 270.2/1863 | 13.2 | 50.2 | 281.6/1942* | 1.04 |
| 14 | 11.55 | 11.02 | 1.02 | 1.54 | 248.7/1714 | 262.9/1813 | 13.9 | 50.7 | 262.2/1808* | 1.00 |
| 15 | 11.62 | 11.03 | 1.03 | 1.54 | 247.8/1708 | 262.4/1809 | 12.4 | 48.3 | 289.3/1995* | 1.10 |
| 16 | 11.68 | 11.09 | 1.47 | 1.52 | 238.3/1643 | 251.2/1732 | 15.9 | 56.0 | 318.6/2197* | 1.27 |
| 17 | 11.56 | 10.98 | 1.00 | 1.49 | 239.2/1649 | 254.6/1755 | 12.7 | 39.6 | 289.0/1993* | 1.14 |
| 18 | 11.60 | 11.05 | 1.01 | 1.51 | 235.3/1622 | 250.0/1724 | 11.8 | 42.4 | 311.9/2150* | 1.25 |
| A | 12.63 | 8.17 | 2.13 | 0.01 | 210.1/1449 | 224.4/1547 | 14.4 | 59.4 | 346.9/2392* | 1.54 |
| B | 12.61 | 8.20 | 2.14 | 0.016 | 209.2/1442 | 230.1/1586 | 15.9 | 65.4 | 349.8/2412 | 1.52 |
| C | 11.66 | 8.61 | 0.11 | 1.10 | 250.5/1727 | 254.3/1753 | 12.2 | 52.0 | 319.6/2204* | 1.26 |
| D | 11.58 | 8.29 | 0.09 | 1.18 | 251.0/1731 | 259.3/1788 | 10.7 | 46.7 | 329.7/2273 | 1.27 |

*The value reported is an average of two measurements.

The data in Table 4 show that Examples 1–18 of the present invention provide superior yield and tensile strength compared to Heats A and B, while providing acceptable levels of notch toughness, as indicated by the NTS/UTS ratio, and ductility. Thus, it is seen that Examples 1–18 provide a superior combination of strength and ductility relative to Heats A and B.

Moreover, the data in Table 4 also show that Examples 1–18 of the present invention provide tensile strength that is at least as good as to significantly better than Heats C and D, while providing acceptable yield strength and ductility, as well as an acceptable level of notch toughness as indicated by the NTS/UTS ratio.

The stress-corrosion cracking resistance properties of Examples 7–11 in a chloride-containing medium were compared to those of Comparative Heats B and D via slow-strain-rate testing. For the stress-corrosion cracking test, the specimens of Examples 7–11 were solution treated similarly to the tensile specimens and then over-aged at a temperature selected to provide a high level of strength. The specimens of Comparative Heats B and D were solution treated similarly to their respective tensile specimens, but over-aged at a temperature selected to provide the level of stress-corrosion cracking resistance typically specified in the aircraft industry. More specifically, Examples 7–11 were age hardened at 1000° F. (538° C.) for 4 hours and then air-cooled and Comparative Heats B and D were age hardened at 1050° F (566° C.) for 4 hours and then air-cooled.

The resistance to stress-corrosion cracking was tested by subjecting sets of the specimens of each example/heat to a tensile stress by means of a constant extension rate of $4\times10^{-6}$ inches/sec ($1\times10^{-5}$ cm/sec). Tests were conducted in each of four different media: (1) a boiling solution of 10.0% NaCl acidified to pH 1.5 with $H_3PO_4$; (2) a boiling solution of 3.5% NaCl at its natural pH (4.9–5.9); (3) a boiling solution of 3.5% NaCl acidified to pH 1.5 with $H_3PO_4$; and (4) air at 77° F. (25° C.). The tests conducted in air were used as a reference against which the results obtained in the chloride-containing media could be compared.

The results of the stress-corrosion testing are given in Table 5 including the time-to-fracture of the test specimen (Total Test Time) in hours, the percent elongation (% Elong.), and the reduction in cross-sectional area (% Red. in Area).

TABLE 5

| Rx./Ht. No. | Environment | Total Test Time (hrs) | % Elong. | % Red. in Area |
|---|---|---|---|---|
| 7 | Boiling 10.0% NaCl at pH 1.5 | 8.5 | 4.9 | 21.5 |
| | " | | | |
| | Boiling 3.5% NaCl at pH 1.5 | 13.5 | 11.3 | 53.7 |
| | " | 13.6 | 11.1 | 58.6 |
| | " | 12.6 | 11.5 | 53.9 |
| | Boiling 3.5% NaCl at pH 5.8 | 14.4 | 12.0 | 62.0 |
| | " | 13.8 | 11.7 | 60.2 |
| | Air at 77° F. (25° C.) | 14.4 | 12.6 | 60.4 |
| | Air at 77° F. (25° C.)(1) | 12.6 | 10.6 | 58.6 |
| | " | 14.2 | 12.8 | 56.1 |
| 8 | Boiling 10.0% NaCl at pH 1.5 | 8.2 | 5.4 | 23.8 |
| | " | 8.3 | 5.3 | 21.4 |
| | Boiling 3.5% NaCl at pH 1.5 | 13.0 | 11.0 | 54.4 |
| | " | 13.3 | 11.0 | 53.4 |
| | Boiling 3.5% NaCl at pH 5.9 | 13.9 | 13.8 | 64.8 |

TABLE 5-continued

| Rx./Ht. No. | Environment | Total Test Time (hrs) | % Elong. | % Red. in Area |
|---|---|---|---|---|
| | " | 14.1 | 13.8 | 64.1 |
| | " | 14.0 | 13.4 | 62.4 |
| | Air at 77° F. (25° C.) | 14.6 | 14.3 | 63.7 |
| | " | 14.0 | 13.6 | 63.2 |
| 9 | Boiling 10.0% NaCl at pH 1.5 | 10.0 | 6.6 | 20.6 |
| | " | 10.3 | 6.2 | 20.7 |
| | Boiling 3.5% NaCl at pH 1.5 | 12.6 | 10.6 | 50.1 |
| | " | 12.8 | 12.0 | 49.5 |
| | Boiling 3.5% NaCl at pH 4.9 | 13.6 | 12.2 | 55.8 |
| | " | 13.6 | 12.0 | 54.4 |
| | Air at 77° F. (25° C.) | 13.8 | 12.6 | 59.6 |
| | " | 14.0 | 12.8 | 58.5 |
| 10 | Boiling 10.0% NaCl at pH 1.5 | 9.6 | 7.0 | 27.9 |
| | " | 10.4 | 7.7 | 17.9 |
| | Boiling 3.5% NaCl at pH 1.5 | 13.7 | 11.8 | 58.1 |
| | | 13.8 | 11.5 | 54.0 |
| | Boiling 3.5% NaCl at pH 5.9 | 13.5 | 13.3 | 61.8 |
| | " | 14.3 | 14.6 | 61.7 |
| | " | 14.0 | 11.9 | 52.8 |
| | Air at 77° F. (25° C.) | 14.4 | 13.1 | 63.8 |
| | " | 14.4 | 12.7 | 63.9 |
| 11 | Boiling 10.0% NaCl at pH 1.5 | 9.5 | 6.5 | 20.8 |
| | " | 9.5 | 5.0 | 22.2 |
| | " | 11.3 | 7.2 | 22.9 |
| | Boiling 3.5% NaCl at pH 1.5 | 13.5 | 10.8 | 58.6 |
| | " | 13.9 | 11.0 | 56.5 |
| | " | 13.0 | 11.6 | 53.2 |
| | Boiling 3.5% NaCl at pH 5.8 | 14.6 | 12.3 | 62.8 |
| | " | 14.1 | 12.7 | 61.6 |
| | Air at 77° F. (25° C.) | 14.4 | 12.7 | 61.5 |
| | Air at 77° F. (25° C.)[1] | 13.4 | 11.5 | 58.5 |
| | " | 13.6 | 11.3 | 53.8 |
| B | Boiling 10.0% NaCl at pH 1.5 | 14.9 | 14.5 | 51.7 |
| | " | 15.2 | 16.6 | 65.2 |
| | " | 13.7 | 12.9 | 59.8 |
| | Boiling 3.5% NaCl at pH 1.5 | 14.2 | 13.3 | 69.9 |
| | | 13.5 | 14.0 | 69.9 |
| | " | 13.8 | 14.5 | 68.4 |
| | Boiling 3.5% NaCl at pH 5.8 | 13.4 | 13.9 | 66.1 |
| | " | 13.6 | 13.3 | 67.6 |
| | Air at 77° F. (25° C.) | 14.1 | 15.1 | 69.9 |
| | Air at 77° F. (25° C.)[1] | 15.1 | 15.7 | 69.7 |
| | " | 15.4 | 15.4 | 69.3 |
| D | Boiling 10.0% NaCl at pH 1.5 | 7.4 | 3.7 | 6.9 |
| | " | 9.6 | 8.3 | 15.6 |
| | " | 10.2 | 10.0 | 19.2 |
| | Boiling 3.5% NaCl at pH 1.5 | 13.4 | 11.3 | 49.6 |
| | " | 13.2 | 10.1 | 46.1 |
| | " | 12.8 | 10.7 | 44.5 |
| | Boiling 3.5% NaCl at pH 5.8 | 13.4 | 11.S | 51.3 |
| | " | 13.4 | 11.9 | 52.0 |
| | Air at 77° F. (25° C.) | 14.1 | 15.2 | 56.0 |
| | Air at 77° F. (25° C.)[1] | 15.1 | 14.4 | 54.4 |
| | " | 15.8 | 15.4 | 59.6 |

[1]These measurements represent the references values for the boiling 10.0% NaCl test conditions only.

The relative stress-corrosion cracking resistance of the tested alloys can be better understood by reference to a ratio of the measured parameter in the corrosive medium to the measured parameter in the reference medium. Table 6 summarizes the data of Table 5 by presenting the data in a ratio format for ease of comparison. The values in the column labeled "TC/TR" are the ratios of the average time-to-fracture under the corrosive condition to the average time-to-fracture under the reference condition. The values in the column labeled "EC/ER" are the ratios of the average % elongation under the indicated corrosive condition to the average % elongation under the reference condition. Likewise, the values in the column labeled "RC/RR" are the ratios of the average % reduction in area under the indicated corrosive condition to the average % reduction in area under the reference condition.

TABLE 6

| Ex./Ht. No. | TC/TR[1] | EC/ER[2] | RC/RR[3] |
|---|---|---|---|
| | (Boiling 10.0% NaCl at pH 1.5) | | |
| 7 | .67 | .44 | .41 |
| 8 | .58 | .38 | .36 |
| 9 | .73 | .50 | .35 |
| 10 | .69 | .57 | .36 |
| 11 | .75 | .55 | .39 |
| B | .96 | .94 | .85 |
| D | .59 | .49 | .24 |
| | (Boiling 3.5% NaCl at pH 1.5) | | |
| 7 | .92 | .90 | .92 |
| 8 | .92 | .79 | .85 |
| 9 | .91 | .89 | .84 |
| 10 | .95 | .90 | .88 |
| 11 | .94 | .88 | .91 |
| B | .98 | .92 | .99 |
| D | .93 | .70 | .83 |
| | (Boiling 3.5% NaCl at pH 4.9–5.9) | | |
| 7 | .98 | .94 | 1.0 |
| 8 | .98 | .98 | 1.0 |
| 9 | .98 | .95 | .93 |
| 10 | .97 | 1.0 | .92 |
| 11 | 1.0 | .98 | 1.0 |
| B | .96 | .90 | .96 |
| D | .95 | .77 | .92 |

[1]TC/TR = Average time-to-fracture under corrosive conditions divided by average time-to-fracture under reference conditions.
[2]EC/ER = Average elongation under corrosive conditions divided by average elongation under reference conditions.
[3]RC/RR = Average reduction in area under corrosive conditions divided by average reduction in area under reference conditions.

The mechanical properties of Examples 7–11 and Heats B and D were also determined and are presented in Table 7 including the 0.2% offset yield strength (0.2% YS) and the ultimate tensile strength (UTS) in ksi (MPa), the percent elongation in four diameters (% Elong.), the reduction in area (% Red. in Area), and the notch tensile strength (NTS) in ksi (MPa).

TABLE 7

| Ex./ Ht. No. | Condi-tion | .2% YB (ksi/MPa) | UTS (ksi/MPa) | % E-long. | % Red. in Area | NTS (ksi/MPa) |
|---|---|---|---|---|---|---|
| 7 | H1000 | 216.8/1495 | 230.5/1589 | 15.0 | 62.5 | 344.6/2376 |
| 8 | H1000 | 223.0/1538 | 233.6/1611 | 14.5 | 64.0 | 353.0/2434 |
| 9 | H1000 | 223.4/1540 | 234.8/1619 | 14.8 | 64.3 | 349.6/2410 |
| 10 | H1000 | 219.3/1512 | 230.0/1586 | 14.4 | 65.0 | 348.6/2404 |
| 11 | H1000 | 210.5/1451 | 230.9/1592 | 15.0 | 63.0 | 344.2/2373 |
| B | H1050 | 184.1/1269 | 190.8/1316 | 17.9 | 72.3 | 303.4/2092 |
| D | H1050 | 182.9/1261 | 196.9/1358 | 17.6 | 62.1 | 296.3/2043 |

When considered together, the data presented in Tables 6 and 7 demonstrate the unique combination of strength and stress corrosion cracking resistance provided by the alloy according to the present invention, as represented by Examples 7–11. More particularly, the data in Tables 6 and 7 show that Examples 7–11 are capable of providing significantly higher strength than comparative Heats B and D, while providing a level of stress corrosion cracking resistance that is comparable to those alloys. Additional specimens of Examples 7 and 11 were age hardened at 1050° F. (538° C.) for 4 hours and then air-cooled. Those specimens provided room temperature ultimate tensile strengths of 214.3 ksi and 213.1 ksi, respectively, which are still significantly better than the strength provided by Heats B and D when similarly aged. Although not tested, it would be expected that the stress corrosion cracking resistance of Examples 7 and 11 would be at least the same or better when aged at the higher temperature. In addition, it should be noted that the boiling 10.0% NaCl conditions are more severe than recognized standards for the aircraft industry.

With reference to Examples 19–30, the bars of each example were rough turned to produce smooth tensile and notched tensile specimens having the dimensions indicated in Table 2. Each specimen was cylindrical with the center of each specimen being reduced in diameter and a minimum radius connecting the center section to each end section of the specimen. In addition, CVN test specimens (ASTM E 23-96) and compact tension blocks for fracture toughness testing (ASTM E399) were machined from the annealed bar. All of the test specimens were solution treated at 1800° F. (982° C.) for 1 hour then water quenched, cold treated at −100° F. (−73° C.) for either 1 or 8 hours then warmed in air, and aged at either 900° F. (482° C.) or 1000° F. (538° C.) for 4 hours then air cooled.

The mechanical properties measured include the 0.2% yield strength (0.2% YS), the ultimate tensile strength (UTS), the percent elongation in four diameters (% Elong.), the percent reduction in area (% Red.), the notch tensile strength (NTS), the room-temperature Charpy V-notch impact strength (CVN), and the room-temperature fracture toughness ($K_{Ic}$). The results of the measurements are given in Tables 8–11.

TABLE 8

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| 26 | 4.5 × 2.75/11 × 7.0 | Longitudinal | 231.3/1595 | 249.0/1717 | 13.8 | 55.7 | 328.6/2266 | 1.32 | 10/14† | 72.6/79.8 |
| | | Transverse | 227.1/1566 | 245.3/1691 | 10.9 | 40.8 | 318.5/2196 | 1.30 | 9/12† | 68.7/75.5 |
| | 4.5 × 1.5/11 × 3.8 | Longitudinal | 236.4/1630 | 254.2/1753 | 13.3 | 54.6 | 342.3/2360 | 1.35 | 12/16† | 74.6/82.0 |
| | | Transverse | 230.3/1588 | 255.4/1761 | 12.3 | 51.9 | 320.1/2207 | 1.25 | 12/16 | 74.9/82.3 |
| 27 | 4.5 × 2.75/11 × 7.0 | Longitudinal | 224.0/1544 | 246.4/1699 | 14.8 | 59.0 | 349.9/2412 | 1.42 | 21/28† | 90.9/99.9 |
| | | Transverse | 211.4/1458 | 239.2/1649 | 14.0 | 50.9 | 343.9/2371 | 1.44 | 14/19† | 79.9/87.8 |
| | 4.5 × 1.5/11 × 3.8 | Longitudinal | 221.2/1525 | 242.9/1675 | 14.5 | 61.1 | 348.4/2402 | 1.43 | 19/26† | 95.5/105 |
| | | Transverse | 213.7/1473* | 245.8/1695* | 13.8* | 51.1* | 348.1/2400 | 1.42 | 18/24 | 84.0/92.3 |
| 28 | 4.5 × 2.75/11 × 7.0 | Longitudinal | 234.8/1619 | 253.6/1748 | 12.5 | 54.9 | 332.0/2289 | 1.31 | 11/15† | 69.4/76.2 |
| | | Transverse | 232.7/1604 | 252.8/1743 | 12.1 | 51.7 | 335.3/2312 | 1.33 | 10/14† | 71.9/79.0 |
| | 4.5 × 1.5/11 × 3.8 | Longitudinal | 231.1/1593 | 252.0/1738 | 12.6 | 54.4 | 328.5/2265 | 1.30 | 11/15† | 78.8/86.6 |
| | | Transverse | 228.8/1578 | 253.6/1748 | 12.4 | 53.6 | 330.2/2277 | 1.30 | 9/12 | 73.7/81.0 |
| 19 | 4.5 × 2.75/11 × 7.0 | Longitudinal | 223.6/1542 | 244.3/1684 | 14.3 | 56.9 | 341.3/2353 | 1.40 | 15/20† | 89.9/98.8 |
| | | Transverse | 224.0/1544 | 243.8/1681 | 10.8 | 43.0 | 313.3/2160 | 1.29 | 8/11† | 71.2/78.2 |
| | 4.5 × 1.5/11 × 3.8 | Longitudinal | 222.7/1536 | 243.2/1677 | 15.0 | 60.0 | 343.3/2367 | 1.41 | 19/26† | 94.0/103 |
| | | Transverse | 215.7/1487 | 241.0/1662 | 11.6 | 43.5 | 325.4/2244 | 1.35 | 11/15 | 82.1/90.2 |
| 20 | 4.5 × 2.75/11 × 7.0 | Longitudinal | 229.8/1584 | 247.8/1708 | 13.7 | 57.5 | 343.8/2370 | 1.39 | 9/12† | 74.0/81.3 |
| | | Transverse | 229.2/1580 | 249.2/1718 | 12.6 | 49.8 | 324.9/2240 | 1.30 | 10/14† | 70.3/77.2 |
| | 4.5 × 1.5/11 × 3.8 | Longitudinal | 225.9/1558 | 244.5/1686 | 14.3 | 59.2 | 339.2/2339 | 1.39 | 11/15† | 82.6/90.8 |
| | | Transverse | 229.3/1581 | 249.1/1718 | 12.1 | 48.7 | 334.2/2304 | 1.34 | 11/15 | 81.4/89.4 |
| 21 | 4.5 × 2.75/11 × 7.0 | Longitudinal | 242.6/1673 | 260.4/1795 | 11.8 | 53.8 | 234.1/1614 | 0.90 | 5/7† | 48.5/53.3 |
| | | Transverse | 245.2/1691 | 263.5/1817 | 10.3 | 43.7 | 218.8/1509 | 0.83 | 6/8† | 47.0/51.6 |
| | 4.5 × 1.5/11 × 3.8 | Longitudinal | 240.8/1660 | 258.9/1785 | 12.2 | 51.3 | 262.8/1812 | 1.02 | 5/7† | 55.8/61.3 |
| | | Transverse | 243.1/1676 | 262.4/1809 | 10.8 | 47.4 | 235.5/1624 | 0.90 | 5/7 | 53.3/58.6 |
| 22 | 4.5 × 2.75/11 × 7.0 | Longitudinal | 227.0/1565 | 246.5/1700 | 13.4 | 56.0 | 332.1/2290 | 1.35 | 10/14† | 76.4/84.0 |
| | | Transverse | 226.8/1564 | 248.8/1715 | 12.3 | 50.4 | 322.7/2225 | 1.30 | 10/14† | 74.0/81.3 |
| | 4.5 × 1.5/11 × 3.8 | Longitudinal | 226.2/1560 | 246.3/1698 | 13.3 | 55.7 | 329.3/2270 | 1.34 | 12/16† | 85.6/94.1 |
| | | Transverse | 223.0/1538 | 247.4/1706 | 11.6 | 47.9 | 318.9/2199 | 1.29 | 11/15 | 75.4/82.8 |

The test specimens were solution treated at 1800° F. (982° C.) for 1 hour then water quenched, cold treated at −100° F. (−73° C.) for 1 hour then warmed in air, and aged at 900° F. (482° C.) for 4 hours then air cooled. The values reported are an average of two measurements, except for the values indicated with a "*" which are from a single measurement and the values indicated with a "†" which are an average of three measurements.

TABLE 9

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| 26 | 4.5 × 2.75/11 × 7.0 | Longitudinal | 209.1/1442 | 225.1/1552 | 15.2 | 63.9 | 340.3/2346 | 1.51 | 29/39† | 108.9/119.7 |
| | | Transverse | 210.0/1448 | 225.2/1553 | 13.4 | 54.5 | 332.9/2295 | 1.48 | 19/26† | 98.2/108 |
| | 4.5 × 1.5/11 × 3.8 | Longitudinal | 211.2/1456 | 227.9/1571 | 15.1 | 63.0 | 342.4/2361 | 1.50 | 28/38† | 113.6/124.8 |
| | | Transverse | 212.1/1462 | 225.0/1551 | 13.3 | 56.2 | 337.7/2328 | 1.50 | 22/30 | 97.0/106 |
| 27 | 4.5 × 2.75/11 × 7.0 | Longitudinal | 204.8/1412 | 220.0/1517 | 17.0 | 67.8 | 343.9/2371 | 1.56 | 47/64† | 109.6/120.4 |
| | | Transverse | 201.1/1386 | 220.1/1518 | 15.1 | 62.2 | 322.5/2224 | 1.47 | 30/41† | 103.2/113.4 |
| | 4.5 × 1.5/11 × 3.8 | Longitudinal | 205.7/1418 | 219.4/1513 | 17.4 | 68.2 | 343.5/2368 | 1.57 | 50/68† | 115.8/127.2 |
| | | Transverse | 206.9/1426 | 221.3/1526 | 14.3 | 57.7 | 332.8/2295 | 1.50 | 34/46 | 106.3/116.8 |
| 28 | 4.5 × 2.75/11 × 7.0 | Longitudinal | 289.9/1447 | 224.8/1550 | 15.2 | 65.0 | 340.0/2344 | 1.51 | 39/53† | 106.1/116.6 |
| | | Transverse | 210.5/1451 | 225.7/1556 | 14.5 | 62.2 | 338.8/2336 | 1.50 | 31/42† | 97.9/108 |
| | 4.5 × 1.5/11 × 3.8 | Longitudinal | 210.6/1452 | 224.7/1549 | 15.4 | 66.0 | 332.9/2295 | 1.48 | 39/53† | 111.7/122.7 |
| | | Transverse | 206.3/1422 | 221.8/1529 | 14.1 | 61.6 | 327.0/2255 | 1.47 | 31/42 | 105.6/116.0 |
| 19 | 4.5 × 2.75/11 × 7.0 | Longitudinal | 201.2/1387 | 217.0/1496 | 16.1 | 64.5 | 335.5/2313 | 1.55 | 31/42† | 112.4/123.5 |
| | | Transverse | 201.3/1388 | 219.5/1513 | 12.7 | 48.9 | 320.0/2206 | 1.46 | 14/19† | 113.1/124.3 |
| | 4.5 × 1.5/11 × 3.8 | Longitudinal | 197.1/1359 | 213.3/1471 | 16.9 | 66.3 | 328.9/2268 | 1.54 | 40/54† | 101.6/111.6 |

TABLE 9-continued

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| | | Transverse | 196.9/1358 | 211.4/1458 | 14.9 | 53.2 | 300.4/2071 | 1.42 | 17/23 | 93.7/103 |
| 20 | 4.5 × 2.75/11 × 7.0 | Longitudinal | 289.3/1443 | 223.5/1541 | 16.5 | 67.0 | 347.8/2398 | 1.56 | 33/45† | 105.4/115.8 |
| | | Transverse | 211.0/1455 | 225.6/1556 | 12.7 | 49.9 | 337.9/2330 | 1.50 | 22/30† | 99.7/110 |
| | 4.5 × 1.5/11 × 3.8 | Longitudinal | 200.4/1382 | 219.5/1513 | 16.2 | 66.6 | 343.0/2365 | 1.56 | 36/49† | 111.3/122.3 |
| | | Transverse | 207.2/1429 | 221.8/1529 | 14.3 | 59.4 | 340.0/2344 | 1.53 | 23/31 | 103.6/113.8 |
| 21 | 4.5 × 2.75/11 × 7.0 | Longitudinal | 216.4/1492* | 229.4/1582 | 14.8 | 65.6 | 342.0/2358 | 1.49 | 20/27† | 89.3/98.1 |
| | | Transverse | 219.2/1511 | 231.6/1597 | 13.2 | 59.4 | 342.1/2359 | 1.48 | 17/23† | 86.0/94.5 |
| | 4.5 × 1.5/11 × 3.8 | Longitudinal | 217.6/1500 | 230.3/1588 | 14.8 | 64.4 | 343.2/2366 | 1.49 | 23/31† | 100.0/109.9 |
| | | Transverse | 218.5/1506 | 230.7/1591 | 12.0 | 54.8 | 340.6/2348 | 1.48 | 17/23 | 92.4/102 |
| 22 | 4.5 × 2.75/11 × 7.0 | Longitudinal | 203.8/1405 | 219.6/1514 | 15.5 | 65.5 | 329.8/2274 | 1.50 | 42/57† | 95.6/105 |
| | | Transverse | 202.7/1398 | 219.2/1511 | 13.6 | 55.4 | 324.3/2236 | 1.48 | 28/38† | 97.7/107 |
| | 4.5 × 1.5/11 × 3.8 | Longitudinal | 202.6/1397 | 218.4/1506 | 16.0 | 66.1 | 325.6/2245 | 1.49 | 44/60† | 110.0/120.9 |
| | | Transverse | 202.2/1394 | 219.6/1514 | 13.7 | 57.1 | 327.0/2255 | 1.49 | 25/34 | 99.8/110 |

The test specimens were solution treated at 1800° F. (982° C.) for 1 hour then water quenched, cold treated at −100° F. (−73° C.) for 1 hour then warmed in air, and aged at 1000° F. (538° C.) for 4 hours then air cooled. The values reported are an average of two measurements, except for the values indicated with a "*" which are from a single measurement and the values indicated with a "†" which are an average of three measurements.

TABLE 10

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| 27 | 4.5 × 2.75/11 × 7.0 | Longitudinal | 234.8/1619 | 259.8/1791 | 13.2 | 58.2 | 352.4/2430 | 1.36 | — | — |
| 28 | 4.5 × 2.75/11 × 7.0 | Longitudinal | 233.8/1612 | 254.7/1756 | 12.8 | 56.3 | 336.5/2320 | 1.32 | — | — |
| | | | 239.0/1648 | 258.8/1784 | 12.8 | 56.3 | 336.5/2320 | 1.32 | — | — |
| | | Transverse | 234.1/1614 | 256.3/1767 | 12.1 | 51.3 | 320.8/2212. | 1.25 | — | 70.7/77.7 |
| | 4.5 × 1.5/11 × 3.8 | Longitudinal | 238.4/1644 | 258.0/1779 | 12.8 | 55.8 | 335.5/2313 | 1.30 | — | — |
| 29 | 4.5 × 2.75/11 × 7.0 | Longitudinal | 241.3/1664 | 260.2/1794 | 12.6 | 56.0 | 297.2/2049 | 1.14 | 6/8† | 56.5/62.1 |
| | | Transverse | 246.5/1700 | 264.8/1826 | 10.3 | 45.3 | 305.3/2105 | 1.15 | 6/8† | 55.5/61.0 |
| | 4.5 × 1.5/11 × 3.8 | Longitudinal | 239.8/1653 | 258.9/1785 | 12.9 | 56.7 | 331.0/2282 | 1.28 | 8/11† | 62.9/69.1 |
| | | Transverse | 238.5/1644 | 257.4/1775 | 11.6 | 49.5 | 314.5/2168 | 1.22 | 6/8 | 62.8/69.0 |
| 30 | 4.5 × 1.62/11 × | Longitudinal | 236.2/1628 | 255.8/1764 | 13.3 | 58.6 | 358.B/2474 | 1.40 | — | 81.2/89.2 |
| | 4.11 | Transverse | 233.3/1609 | 256.6/1769 | 12.2 | 50.6 | 359.0/2475 | 1.40 | — | 71.6/78.7 |
| 19 | 4.5 × 2.75/11 × 7.0 | Longitudinal | 227.6/1569 | 256.5/1768 | 13.0 | 57.9 | 346.2/2387 | 1.35 | — | — |
| 20 | 4.5 × 2.75/11 × 7.0 | Longitudinal | 236.6/1631 | 257.4/1775 | 12.9 | 56.8 | 346.1/2386 | 1.34 | — | — |
| 21 | 4.5 × 2.75/11 × 7.0 | Longitudinal | 242.9/1675 | 263.1/1814 | 12.1 | 52.5 | 241.4/1664 | 0.92 | — | — |
| 22 | 4.5 × 2.75/11 × 7.0 | Longitudinal | 231.7/1598 | 254.1/1752 | 13.6 | 58.8 | 344.1/2372 | 1.35 | — | — |
| 23 | 4.5 × 2.75/11 × 7.0 | Longitudinal | 238.8/1646 | 258.9/1785 | 12.6 | 55.0 | 281.3/1940 | 1.09 | 5/7† | 58.5/64.3 |
| | | Transverse | 240.4/1658 | 259.2/1787 | 10.7 | 43.9 | 294.2/2028 | 1.14 | 6/8† | 56.0/61.5 |
| | 4.5 × 1.5/11 × 3.8 | Longitudinal | 235.1/1621 | 254.5/1755 | 12.7 | 54.6 | 316.0/2179 | 1.24 | 7/9† | 66.7/73.3 |
| | | Transverse | 236.4/1630 | 256.5/1768 | 11.3 | 48.4 | 280.9/1937 | 1.10 | 7/9 | 60.1/66.0 |
| 24 | 4.5 × 2.75/11 × 7.0 | Longitudinal | 237.7/1639 | 257.3/1774 | 12.9 | 56.2 | 339.9/2344 | 1.32 | 7/9† | 63.3/70.0 |
| | | Transverse | 240.0/1655 | 260.8/1798 | 9.5 | 39.1 | 307.4/2120 | 1.18 | 8/11† | 58.7/64.5 |
| | 4.5 × 1.5/11 × 3.8 | Longitudinal | 233.9/1613 | 253.4/1747 | 13.7 | 59.5 | 336.4/2319 | 1.33 | 9/12† | 71.9/79.0 |
| | | Transverse | 233.8/1612 | 254.3/1753 | 11.4 | 47.1 | 310.5/2141 | 1.22 | 8/11 | 66.6/73.2 |
| 25 | 4.5 × 1.62/11 × | Longitudinal | 238.6/1645 | 257.4/1775 | 13.2 | 58.2 | 332.2/2290 | 1.29 | — | 69.0/75.8 |
| | 4.11 | Transverse | 232.9/1606 | 258.3/1781 | 13.0 | 51.4 | 325.0/2241 | 1.26 | — | 67.2/73.8 |

The test specimens were solution treated at 1800° F. (982° C.) for 1 hour then water quenched, cold treated at −100° F. (−73° C.) for 8 hours then warmed in air, and aged at 900° F. (482° C.) for 4 hours then air cooled. The values reported are an average of two measurements, except for the values indicated with a "*" which are from a single measurement and the values indicated with a "†" which are an average of three measurements.

TABLE 11

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| 28 | 4.5 × 2.75/11 × 7.0 | Longitudinal | 214.0/1476 | 228.9/1578 | 15.2 | 65.9 | 335.2/2311 | 1.46 | 35/47 | — |
| | | | 218.2/1504 | 232.1/1600 | 15.1 | 66.2 | 335.2/2311 | 1.46 | 36/49 | — |
| | | Transverse | 212.5/1465 | 227.0/1565 | 14.6 | 62.2 | 346.3/2388 | 1.53 | — | 108.0/118.7 |
| | 4.5 × 1.5/11 × 3.8 | Longitudinal | 213.8/1474 | 227.9/1571 | 14.9 | 64.1 | — | — | — | — |
| 30 | 4.5 × 1.62/11 × | Longitudinal | 216.2/1491 | 230.3/1588 | 15.7 | 66.0 | 353.4/2437 | 1.53 | — | 120.8/132.7 |
| | 4.11 | Transverse | 210.3/1450 | 226.5/1562 | 14.3* | 58.6* | 350.0/2413 | 1.55 | — | 108.2/118.9 |
| 23 | 4.5 × 2.75/11 × 7.0 | Longitudinal | 216.2/1491 | 228.7/1577 | 14.9 | 65.1 | 344.2/2373 | 1.51 | 27/37† | 102.3/112.4 |
| | | Transverse | 217.9/1502 | 231.0/1593 | 12.6 | 53.5 | 336.4/2319 | 1.46 | 22/30† | 91.1/100.1 |
| | 4.5 × 1.5/11 × 3.8 | Longitudinal | 214.6/1480 | 227.6/1569 | 14.9 | 65.7 | 347.7/2397 | 1.53 | 28/38† | 107.5/118.1 |
| | | Transverse | 212.5/1465 | 226.0/1558 | 12.8 | 56.7 | 339.1/2338 | 1.50 | 21/28 | 97.8/107.5 |
| 24 | 4.5 × 2.75/11 × 7.0 | Longitudinal | 214.5/1479* | 227.3/1567* | 14.9* | 64.6* | 344.2/2373 | 1.51 | 32/43† | 102.5/112.6 |
| | | Transverse | 215.4/1485 | 228.7/1577 | 12.8 | 53.3 | 334.8/2308 | 1.46 | 23/31† | 96.2/105.7 |
| | 4.5 × 1.5/11 × 3.8 | Longitudinal | 210.9/1454 | 224.7/1549 | 15.5 | 66.4 | 347.5/2396 | 1.55 | 30/41† | 109.4/120.2 |
| | | Transverse | 212.2/1463 | 225.9/1558 | 12.2 | 53.8 | 338.1/2331 | 1.50 | 21/28 | 95.8/105.2 |
| 25 | 4.5 × 1.62/11 × | Longitudinal | 218.2/1504 | 232.0/1600 | 15.1 | 64.4 | 350.3/2415 | 1.51 | — | — |

TABLE 11-continued

| Ex./Ht. No. | Bar Size (in./cm) | Orientation | .2% YS (ksi/MPa) | UTS (ksi/MPa) | % Elong. | % Red. in Area | NTS (ksi/MPa) | NTS/UTS | CVN (ft-lb/J) | $K_{Ic}$ or $K_q$ (ksi √ in/MPa √ m) |
|---|---|---|---|---|---|---|---|---|---|---|
| | 4.11 | | | | | | | | | |
| 29 | 4.5 × 2.75/11 × 7.0 | Longitudinal | 215.8/1488 | 228.5/1576 | 14.7 | 64.3 | 342.8/2364 | 1.50 | 28/38† | 102.5/112.6 |
| | | Transverse | 221.0/1524* | 232.8/1605* | 12.0* | 52.9* | 342.4/2361 | 1.47 | 26/35† | 100.3/110.2 |
| | 4.5 × 1.5/11 × 3.8 | Longitudinal | 217.0/1496 | 229.4/1582 | 14.9 | 65.4 | 347.9/2399 | 1.52 | 28/38† | 107.8/115.4 |
| | | Transverse | 215.7/1487 | 228.5/1576 | 13.4 | 59.5 | 338.9/2337 | 1.48 | 24/32 | 104.8/115.2 |

The test specimens were solution treated at 1800° F. (982° C.) for 1 hour then water quenched, cold treated at −100° F. (−73° C.) for 8 hours then warmed in air, and aged at 1000° F. (538° C.) for 4 hours then air cooled. The values reported are an average of two measurements, except for the values indicated with a "*" which are from a single measurement and the values indicated with a "†" which are an average of three measurements.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. A precipitation hardenable, martensitic stainless steel alloy having a unique combination of stress-corrosion cracking resistance, strength, and notch toughness consisting essentially of, in weight percent, about

| | |
|---|---|
| C | 0.03 max |
| Mn | 1.0 max |
| Si | 0.75 max |
| P | 0.040 max |
| S | 0.020 max |
| Cr | 10–13 |
| Ni | 10.5–11.6 |
| Ti | 1.5–1.8 |
| Mo | 0.25–1.5 |
| Cu | 0.95 max |
| Al | 0.25 max |
| Nb | 0.3 max |
| B | 0.010 max |
| N | 0.030 max |
| Ce | 0.001–0.025 |

the balance essentially iron.

2. The alloy recited in claim 1 which contains no more than about 0.015 weight percent cerium.

3. The alloy recited in claim 1 which contains no more than about 0.010 weight percent cerium.

4. The alloy recited in claim 1 which contains at least about 0.002 weight percent cerium.

5. The alloy recited in claim 1 which contains no more than about 0.75 weight percent copper.

6. The alloy recited in claim 5 which contains no more than about 0.015 weight percent cerium.

7. The alloy recited in claim 5 which contains no more than about 0.010 weight percent cerium.

8. The alloy recited in claim 5 which contains at least about 0.002 weight percent cerium.

9. A method of preparing a precipitation hardenable, martensitic stainless steel alloy having a unique combination of stress-corrosion cracking resistance, strength, and notch toughness, said alloy consisting essentially of the following elements in the following approximate weight percents:

| | |
|---|---|
| C | 0.03 max |
| Mn | 1.0 max |
| Si | 0.75 max |

-continued

| | |
|---|---|
| P | 0.040 max |
| S | 0.020 max |
| Cr | 10–13 |
| Ni | 10.5–11.6 |
| Ti | 1.5–1.8 |
| Mo | 0.25–1.5 |
| Cu | 0.95 max |
| Al | 0.25 max |
| Nb | 0.3 max |
| B | 0.010 max |
| N | 0.030 max |

and the balance essentially iron, said method comprising the steps of:

melting charge materials containing said elements in proportions sufficient to provide said weight percent amounts; and adding cerium to the alloy during the melting thereof, the ratio of the amount of cerium added to the amount of sulfur present in the alloy being at least about 1:1.

10. The method recited in claim 9 wherein the step of adding cerium to the alloy comprises the step of adding cerium to the alloy in an amount such that the ratio of the amount of cerium added to the amount of sulfur present in the alloy is at least about 2:1.

11. The method recited in claim 10 wherein the step of adding cerium to the alloy comprises the step of adding cerium to the alloy in an amount such that the ratio of the amount of cerium added to the amount of sulfur present in the alloy is at least about 3:1.

12. The method recited in claim 9 wherein the step of adding cerium to the alloy comprises the step of adding cerium to the alloy in an amount such that the ratio of the amount of cerium added to the amount of sulfur present in the alloy is not more than about 15:1.

13. The method recited in claim 12 wherein the step of adding cerium to the alloy comprises the step of adding cerium to the alloy in an amount such that the ratio of the amount of cerium added to the amount of sulfur present in the alloy is not more than about 12:1.

14. A precipitation hardenable, martensitic stainless steel alloy product having a unique combination of stress-corrosion cracking resistance, strength, and notch toughness, said alloy consisting essentially of, in weight percent, about

| | |
|---|---|
| C | 0.03 max |
| Mn | 1.0 max |
| Si | 0.75 max |
| P | 0.040 max |
| S | 0.020 max |
| Cr | 10–13 |
| Ni | 10.5–11.6 |

-continued

| | |
|---|---|
| Ti | 1.5–1.8 |
| Mo | 0.25–1.5 |
| Cu | 0.95 max |
| Al | 0.25 max |
| Nb | 0.3 max |
| B | 0.010 max |
| N | 0.030 max |
| Ce | up to 0.025 |

and the balance essentially iron, said alloy product being prepared by:

melting charge materials containing C, Mn, Si, P, S, Cr, Ni, Ti, Mo, Cu, Al, Nb, B, N, and Fe in proportions sufficient to provide said weight percent amounts; and adding cerium to the alloy during the melting thereof, the ratio of the amount of cerium added to the amount of sulfur present in the alloy being at least about 1:1.

15. The product recited in claim 14 which is prepared by adding cerium to the alloy in an amount such that the ratio of the amount of cerium added to the amount of sulfur present in the alloy is at least about 2:1.

16. The product recited in claim 15 which prepared by adding cerium to the alloy in an amount such that the ratio of the amount of cerium added to the amount of sulfur present in the alloy is at least about 3:1.

17. The product recited in claim 14 which is prepared by adding cerium to the alloy in an amount such that the ratio of the amount of cerium added to the amount of sulfur present in the alloy is not more than about 15:1.

18. The product recited in claim 17 which is prepared by adding cerium to the alloy in an amount such that the ratio of the amount of cerium added to the amount of sulfur present in the alloy is not more than about 12:1.

* * * * *